United States Patent [19]

Yoshikawa et al.

[11] 4,276,238

[45] Jun. 30, 1981

[54] CARBURETOR WITH AUTOMATIC CHOKING AND ACCELERATION DEVICE

[75] Inventors: Katsushi Yoshikawa, Yokohama; Masaaki Saito, Yokosuka; Tadaki Ota; Mitsumasa Inoue, both of Yokohama, all of Japan

[73] Assignee: Nissan Motor Company, Limited, Yokohama, Japan

[21] Appl. No.: 84,156

[22] Filed: Oct. 12, 1979

[30] Foreign Application Priority Data

Oct. 19, 1978 [JP] Japan ..... 53-128853
Oct. 23, 1978 [JP] Japan ..... 53-145569[U]

[51] Int. Cl.[3] ..... F02M 1/10

[52] U.S. Cl. ..... 261/39 D; 261/44 C; 261/121 B; 123/179 G

[58] Field of Search ..... 261/39 D, 44 B, 44 C, 261/121 B; 123/179 G

[56] References Cited

U.S. PATENT DOCUMENTS

| | | | |
|---|---|---|---|
| 3,278,173 | 10/1966 | Cook et al. | 261/50 A |
| 3,493,217 | 2/1970 | Farley | 261/44 C |
| 3,670,709 | 6/1972 | Eckert et al. | 261/39 D |
| 3,764,120 | 10/1973 | Imai | 261/44 C |
| 3,885,545 | 5/1975 | Charron et al. | 261/39 D |
| 3,897,765 | 8/1975 | Harrison et al. | 26/39 D |
| 3,917,760 | 11/1975 | Swatman | 261/44 C |
| 3,967,610 | 7/1976 | Ross | 261/39 D |
| 4,102,315 | 7/1978 | Fahim et al. | 261/39 D |
| 4,180,533 | 12/1979 | Bonse | 261/39 D |

*Primary Examiner*—Tim R. Miles

*Attorney, Agent, or Firm*—Schwartz, Jeffery, Schwaab, Mack, Blumenthal & Koch

[57] ABSTRACT

A carburetor is disclosed of the variable venturi type, which has a bypass passage bypassing the throttle valve, which is controlled during starting and warming up of the engine by a piston which adjusts its flow resistance, and which is urged against the biasing action of a spring by the vacuum suction downstream of the throttle valve. The maximum open position of this piston is controlled by a heat-sensitive element which advances this position in the direction of closing the bypass passage as the engine warms up, until it is completely closed when the engine is warm. Air is fed into a supplier which supplies fuel to the carburetor inlet passage to mix with the fuel supplied thereby in an amount which varies from a minimum when the vacuum downstream of the throttle valve is minimum to a maximum when the vacuum downstream of the throttle valve is maximum. Further, the amount of fuel supplied by the fuel supplier is adjusted to be greater when the engine temperature is lower than when it is higher. Thereby choking action is provided for a cold engine, and also a function of providing an enriched mixture upon acceleration during warming up is provided.

7 Claims, 10 Drawing Figures

CARBURETOR WITH AUTOMATIC CHOKING AND ACCELERATION DEVICE

BACKGROUND OF THE INVENTION

The present invention relates to an improvement in automatic choking of a variable venturi carburetor in which the effective cross-sectional area of a venturi portion is varied in correspondence to the quantity of air sucked in.

In a conventional variable venturi carburetor such as a so-called SU carburetor, a variable venturi portion is provided upstream of a throttle valve, and the venturi is driven by a vacuum-responsive device so that its degree of opening is controlled by a feedback system, so as to maintain the vacuum value between the variable venturi and the throttle valve substantially constant. With the increase in the venturi opening, therefore, the effective area of the fuel nozzle which supplies fuel to the venturi portion should also be increased, so as to control the fuel flow rate to be proportional to the air flow rate and to control the air/fuel ratio to be always constant. This type of carburetor has good stability performance, and particulates and atomizes the fuel well. However, because its air/fuel ratio is inherently constant, a special mechanism must be provided for supplying air/fuel ratio of higher fuel concentration, on occasions when such is required, such as starting of the engine, warming up of the engine, and acceleration of the engine before the end of warming up of the engine.

It has been formerly proposed to move the position of the jet orifice which is part of the metering jet portion of the fuel supply system, during starting and warming up, so as to enlarge the aperture between this jet orifice and a metering needle inserted thereinto and controlled by the variable venturi, so as to enrich the mixture at these times. Simultaneously the opening of the throttle valve is performed by a cam mechanism, so as to ensure the necessary amount of choking mixture. However, such a device has many problems, such as prevention of oil leakage from the jet moving device, precision positioning of the jet, providing operating power for the cam and the jet mechanism, and so forth; and it is deficient, in that the precision of control of the air/fuel ratio and air flow is insufficeint.

Further, there has also been proposed a device wherein a choke valve air passage is set up in parallel to the venturi portion, the effective cross-sectional area of this choke valve air passage being reduced during starting and warming up of the engine, so as to raise the vacuum value downstream of the variable venturi to a higher value than normal at these times. Thus the amount of fuel sucked in from the fuel nozzle is increased, so as to give the required starting and warming up mixture. This system however does not attack the problem of need for richer mixture during acceleration before the engine is fully warmed up (nor does the first-explained system), and such a type of variable venturi carburetor comes to have as many as three choking mechanisms, which is undue complication.

It has also been proposed to provide a choke valve mechanism as in conventional carburetors, which raises the negative pressure on the main nozzle above the level used in normal operation, whereby the fuel supply is increased. Because automatic manipulation of the amount of opening of such a choke valve is required in correspondence to atmospheric and engine temperature, extra devices such as a bimetallic element, a heater, an ignition diaphragm, and a dynamic pressure system for sucked air, etc., must be provided, which again means that the final carburetor is costly and bulky, and also becomes hard to adjust correctly and to service. Again, this solution does not attach the need for richening of mixture during acceleration before full warming up of the engine.

SUMMARY OF THE INVENTION

Therefore, it is an object of the present invention to provide a variable venturi carburetor in which the control of the quantity and the air/fuel ratio of the air/fuel mixture which is provided for starting and warming up of the engine is automatically provided by an automatic choking device of a simple and compact structure.

It is a further object of the present invention to provide such a carburetor in which further the air/fuel mixture provided during warming up of the engine is richened when the engine is accelerated, so as to avoid misfiring.

According to the present invention, these and other objects are accomplished by a carburetor comprising: a mixture passage; a throttle valve positioned in the mixture passage; a variable venturi valve positioned in the mixture passage upstream of the throttle valve; a vacuum-driven actuator which is controlled by the vacuum in the mixture passage between the throttle valve and the variable venturi valve, and which controls the opening of the variable venturi valve so as to keep said vacuum approximately constant; a variable fuel supplier, which is controlled according to the amount of opening of said variable venturi valve, so as to increase its fuel flow rate approximately in direct proportion to the said amount of opening, and which supplies fuel into the mixture passage; a bypass passage which bypasses the throttle valve in the mixture passage, leading from the upstream of the throttle valve to the downstream of the throttle valve; a piston, which is biased in a first direction by a spring, and which is urged in the direction opposite to said first direction by the vacuum downstream of the throttle valve, and whose motion in the said opposite direction progressively intercepts the bypass passage, so that by its reaching an equilibrium position determined by the balance of said biasing and said urging it adjusts the flow resistance of the bypass passage; a heat-sensitive element which responds to a temperature which is representative of the temperature of the engine, and which when the engine is in the cold state does not affect the positioning of the piston, but which, as the engine warms up, gradually advances the extreme possible position of the piston in said first direction in said opposite direction, and which, when the engine is fully warmed up, advances the extreme possible position of the piston in said first direction so far in said opposite direction that it substantially closes the bypass passage; air being fed into the fuel supplier to mix with the fuel supplied thereby in an amount which varies from a minimum when said vacuum downstream of the throttle valve is minimum, to a maximum when said vacuum is maximum; the amount of fuel supplied by the fuel supplier being adjusted to be greater when the engine temperature is lower than when it is higher.

DESCRIPTION OF THE PREFERRED EMBODIMENTS

Figure 1:
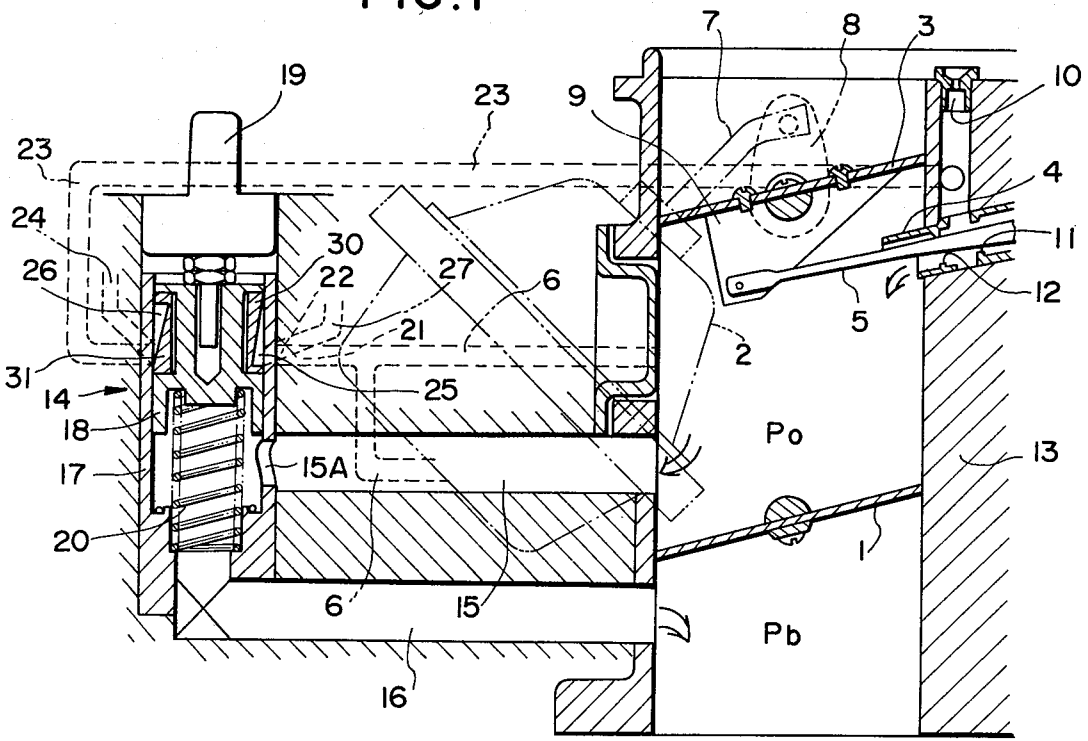
FIG. 1 is vertical section of a first embodiment of the present invention.

FIG. 1 illustrates a first embodiment of the present invention, as applied to an air-valve type variable venturi carburetor of relatively simple structure. The present invention however could be applied to other types of variable venturi carburetors.

In the illustrated carburetor, in a mixture passage which is not designated by any reference numeral is placed a throttle valve 1, and upstream of this throttle valve 1 is placed an air valve 3 which is controlled by a diaphragm means, or vacuum-driven actuator, 2. This diaphragm means 2 is supplied with vacuum Po between the air valve 3 and the throttle valve 1, and maintains this vacuum substantially constant in a per se known way, by feedback. Further, into the mixture passage protrudes a fuel nozzle 4, into which is inserted a jet needle 5 of tapered form. The taper of the jet needle 5 co-operates with a fuel jet portion 11 of the nozzle 4 to meter the quantity of fuel passed therethrough, and the needle 5 is pulled in and out of the nozzle 4 by the bracket 9 which is linked to the air valve 3. The vacuum Po is supplied to the diaphragm means 2 through a passage 6. The taper of the needle 5 is so arranged that in a per se well known way the mixture supplied by the carburetor is kept of a constant air/fuel ratio, whatever may be the amount of opening of the throttle valve 1 and air valve 3. An air bleed passage 10 is provided to bleed air in to be mixed with the fuel in the fuel nozzle 4 before it is ejected, so as to aid the particulation thereof.

Parallelling the main body 13 of the carburetor, and attached to it, is provided an automatic choking device 14 according to the present invention. A bypass passage 15–16 is provided which bypasses the throttle valve 1, leading from its upstream side to its downstream side. This passage passes through the interior of a cylinder 17, within which moves a piston 18, in such a fashion that it can move from a pisition to the upper direction in the figure where it does not substantially interfere with the opening of the passage 15–16, (FIG. 1), to a position in the lower direction in the figure where it substantially closes the passage 15–16, via intermediate positions which partially close the passage 15–16. The piston 18 is biased upward in the figure by a spring 20 and is urged downward in the figure by the vacuum Pb downstream of the throttle valve. Therefore, by reaching an equilibrium position between this biasing and this urging it adjusts the flow resistance of this bypass passage. Further, a heat-sensitive element, which in this embodiment is a wax pellet 19 of a well-known per se sort (although in other possible embodiments other heat-sensitive means such as bimetals, etc. could be used), is arranged to limit the upper end of the range of movement of the piston 18, according to the temperature of the engine, or of the carburetor, which is representative of the engine temperature which is communicated to the wax pellet by conduction and/or convection. However, of course it would be possible, in other embodiments, to provide a heater of a per se well known sort to heat this wax pellet directly. In detail, when the engine is cold, the upper limit of the piston motion is as shown in the drawing, where it does not substantially interfere with the opening of the passage 15–16; but, as the engine warms up, this upper limit is gradually brought down, until when the engine is fully warm the piston is constrained to be in its lowermost position where it substantially completely blocks the passage 15–16.

Figure 2:
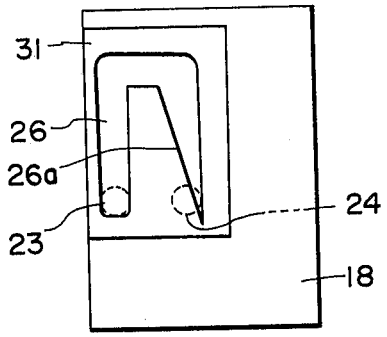
FIG. 2 is an enlarged view of the right part of a piston and controlling members shown in FIG. 1.
Figure 3:
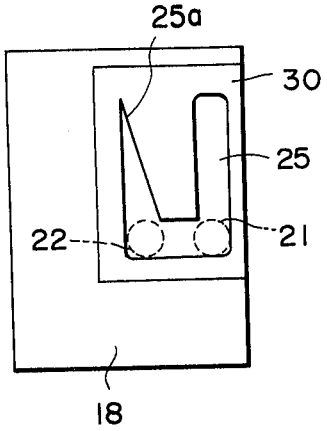
FIG. 3 is a view of the left part of the piston and members, similar to FIG. 2.
Figure 6:
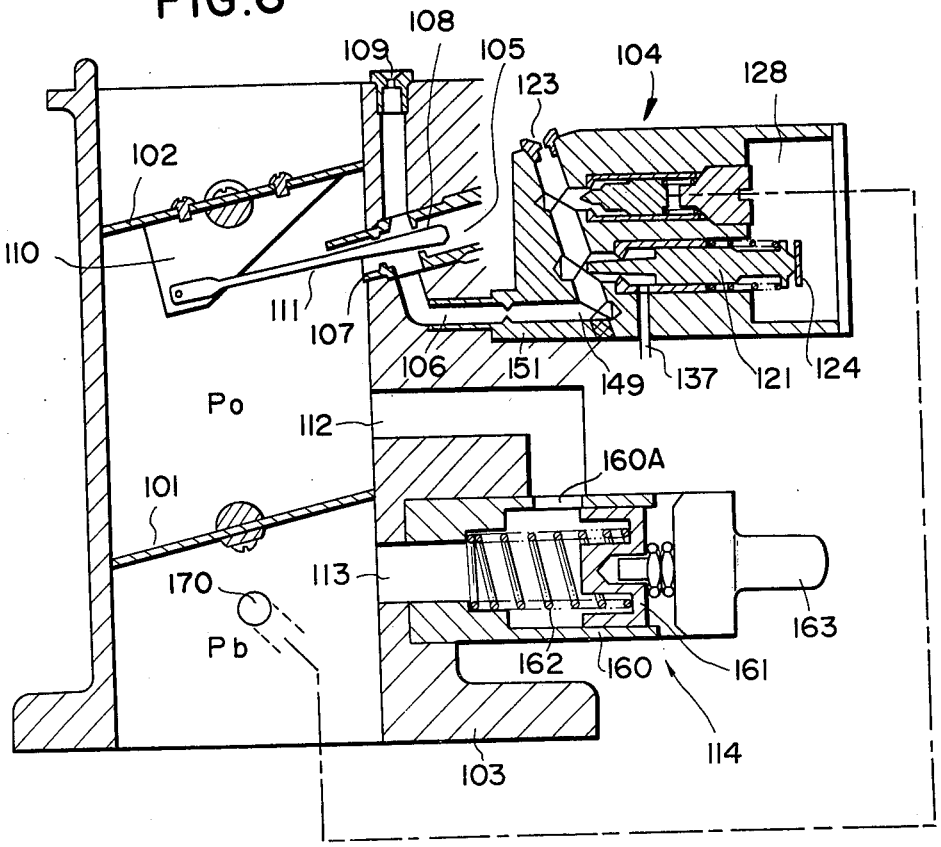
FIG. 6 is a vertical section of a second embodiment of the present invention.
Figure 4:
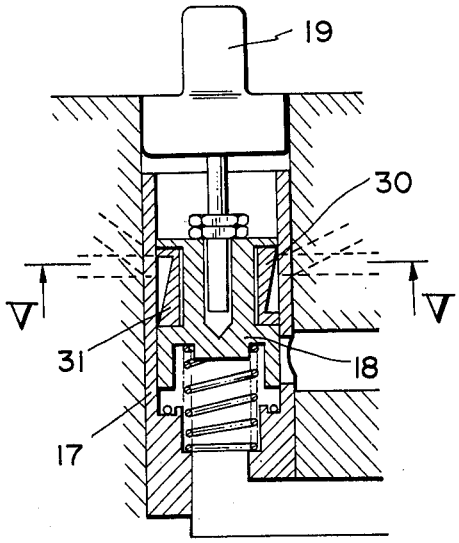
FIG. 4 is an enlarged view of the piston and controlling members, in the downward position.
Figure 5:
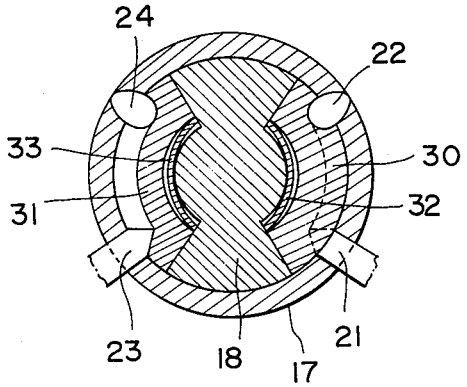
FIG. 5 is a section taken along the line V—V in FIG. 5.

Thus the throttle bypass for choked running is provided. The air/fuel mixture for choked running is provided through the usual running aperture between the needle 5 and the fuel jet portion 11, and through the air bleed 10. It is regulated as follows. On opposite sides of the piston 18 (which is not free to revolve in the cylinder 17) are provided controlling members 30, 31 biased by leaf springs 32, 33, having U-shaped grooves, each of them having one tapered leg, **25*a*, 26*a*, as best seen in FIGS. 2, 3, 4, and 5. These grooves 25 and 26 co-operate respectively with conduits 21 and 22, and with conduits 23 and 24, all of which are formed through the wall of the cylinder 17 to open on its inside. FIGS. 2 and 3 show the state with the piston 18 at the top of its travel. Thus, in this position, the flow resistance between conduits 23 and 24 is maximum, (substantially, in the present embodiment, the communication therebetween is interrupted), and the flow resistance between conduits 21 and 22 is minimum. As the piston 18 moves downwards in the figure, gradually the flow resistance between conduits 23 and 24 decreases, until when the piston 18 is at the bottom of its stroke it is minimum (see FIG. 4) and simultaneously the flow resistance between conduits 21 and 22 increases, until when the piston 18 is at the bottom of its stroke it is maximum (in the present embodiment, the communication between conduits 21 and 22** is substantially interrupted at this point).

The conduits 22 and 24 open to atmosphere, and the conduit 21 opens to the passage 6, and the conduit 23 to air bleed 10.

When the engine is being cranked in the cold state before it is started, the wax pellet 19 is cold, and therefore the piston 18 is at its uppermost position, so that the bypass passage 15–16 is wide open. At this time the flow resistance between conduits 23 and 24 is maximum and that between conduits 21 and 22 is minimum. Thus, air/fuel mixture is allowed to pass through the passage 15–16, and this air/fuel mixture is created by a low air supply which is performed by the air bleed 10, because no air is allowed to pass by the conduits 23 and 24, and by a large amount of fuel sucked from the nozzle 4 by a relatively high vacuum Po provided between the throttle valve 1 and the air valve 3, due to the fact that the operational performance of the diaphragm means 2 to open the air valve 3 is substantially reduced, because of the admixture of atmospheric air through the conduits 21, 22 to the passage 6 to mix with the vacuum which controlls the diaphragm means 2 and dilute it. Therefore this air/fuel mixture is very rich, as is required during cranking of the engine.

When the engine starts, the vacuum Pb downstream of the throttle valve 1 rises, and the piston 18 is sucked downwards in the figure by this vacuum and reaches a balance or equilibrium point against the pressure of the spring 20. At this time the valve aperture 15*a* in the passage 15–16 is somewhat throttled, so as to pass the optimum amount of air/fuel mixture needed for warming-up of the engine. Simultaneously, this downwards movement of the piston 18 reduces the flow resistance between the conduits 23 and 24 and increases that between the conduits 21 and 22. Thereby, more air is caused to be admixed to the fuel supplied to the nozzle 4 (being supplied downstream of the air bleed 10), and also the amount of vacuum supplied to the diaphragm means 2 is made relatively greater, since less air is admixed thereto by the conduits 23 and 24. Therefore, the diaphragm means 2 operates to a greater extent, and the balance value of vacuum Po decreases, so that a lesser amount of fuel is sucked out from the nozzle 4. Thereby, the richness of the mixture supplied to the engine is decreased, and warm-up of the engine progresses smoothly.

If during this warming-up operation the throttle 1 is abruptly opened, then the vacuum Pb drops abruptly, which causes the piston 18 to move upward abruptly, which will suddenly richen the mixture, as is required during sudden acceleration during warming-up operation.

Now, as the engine warms up, the wax pellet 19 expands, and the piston 18 is gradually pushed down; or, strictly speaking, its upper limit of movement is lowered. Finally, the piston is held in the lowermost position, and no choking effect is herein provided. The bypass passage 15–16 is closed; and a larger amount of air is supplied through the conduits 23 and 24 as bleed air, while no substantial air is supplied through the conduits 21 and 22 to be mixed with the vacuum which operates the diaphragm advancer 2. Consequently the engine functions in the normal way.

Thus, it is seen that according to the present invention is provided a carburetor in which during cold starting the amount of bypass opening and the amount of starting mixture are increased, while the richness of this mixture is much increased, by the amount of air introduced therein being reduced, while the amount of fuel introduced therein is increased; and as soon as the engine has started and before it is warmed up, and during the warming-up process, appropriate amounts of choking mixture of the appropriate air/fuel ratio are constantly provided. Further, during sudden acceleration during warming-up, mixture is suddenly richened, so as to provide the function of the old-style "accelerator pump". All this is done by a single simple device of robust and cheap structure, and which possesses inherent reliability, which can simultaneously effect mixture supply control and air/fuel ratio control.

FIGS. 6–10 show a second embodiment of the present invention, in which the choking fuel supply is not metered by the needle, but is independently controlled by another heat-sensitive element.

In a mixture passage which is not designated by any reference numeral is placed a throttle valve 101, and upstream of this throttle valve 101 is placed an air valve 102, which is controlled by a diaphragm means, or vacuum-driven actuator, which is not shown in the figures, in a manner which is per se well known. This diaphragm means is supplied with vacuum Po from between the air valve 102 and the throttle valve 101, and maintains this vacuum substantially constant in a per se well known way, by feedback. Further, into the mixture passage protrudes a fuel nozzle 107, into which is inserted a jet needle 111 of tapered form. The taper of the jet needle 111 co-operates with a fuel jet portion 108 of the nozzle 107 so as to meter the quantity of fuel passed therethrough, and the needle 111 is pulled in and out of the nozzle 107 by the bracket 110 which is linked to the air valve 102. The taper of the needle 111 is so arranged that in a per se well known way the mixture supplied by the carburetor is kept of a constant air/fuel ratio, whatever may be the amount of opening of the throttle valve 101 and air valve 102. An air bleed passage 109 is provided to bleed air in to be mixed with the fuel before it is ejected, so as to aid in the particulation thereof.

Parallelling the main body 103 of the carburetor, and attached to it, is provided an automatic choking device 114 which is part of another embodiment of the present invention. A bypass passage 112–113 is provided which bypasses the throttle valve 101, leading from its upstream side to its downstream side. This passage passes through the interior of a cylinder 160, within which moves a piston 161, in such a fashion that it can move from a position to the right direction in the figure where it does not substantially interfere with the opening 160A of the passage 112–113, to a position in the left direction in the figure where it substantially closes the opening 160A of the passage 112–113. The piston 161 is biased by a spring 162 and is urged in the other direction by the vacuum Pb downstream of the throttle valve. Therefore, by reaching an equilibrium position between this biasing and this urging it adjusts the flow resistance of this bypass passage. Further, a heat-sensitive element, which in this embodiment is a wax pellet 163 of a per se well known sort, (although in other embodiments other heat-sensitive means such as bimetals, etc., could be used) is arranged to limit the right hand end of the range of movement of the piston 161, according to the temperature of the engine, or of the carburetor, which is representative of the engine temperature, which is communicated to the wax pellet by conduction and/or convection. However, of course it would be possible, in other embodiments, to provide a heater of a per se well known sort to heat this wax pellet directly. In detail, when the engine is cold, the right hand end limit of the piston motion is as shown in the drawings, where it does not substantially interfere with the opening of the passage 112–113; but, as the engine warms up, this limit is gradually brought leftwards, until when the engine is fully warm the piston is constrained to be in its leftmost position where it substantially completely blocks the opening 160A of the passage 112–113.

This piston device in itself is similar to the piston device of the first embodiment. However, the flow of choking fuel, and the flow of choking air, are not controlled directly also by this piston, as in the first embodiment, but are independently controlled in a manner that will now be explained.

On the outer wall of the carburetor is attached the auxiliary fuel supply device 104. As illustrated in the drawings, this device 104 is installed in parallel with, and independently of, the main fuel supply path 105. The air/fuel mixture supply path 106 leading from the auxiliary fuel supply device 104 is connected below the metering jet portion 108 of the fuel nozzle 107, so that mixture supplied thereby is not controlled by the needle 111.

Figure 7:
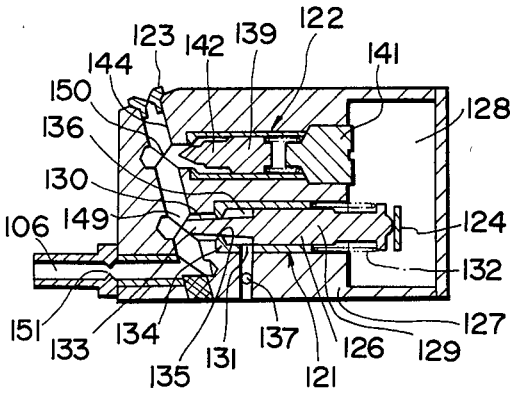
FIG. 7 is a vertical section of the auxiliary fuel supply device of the carburetor shown in FIG. 6.
Figure 8:
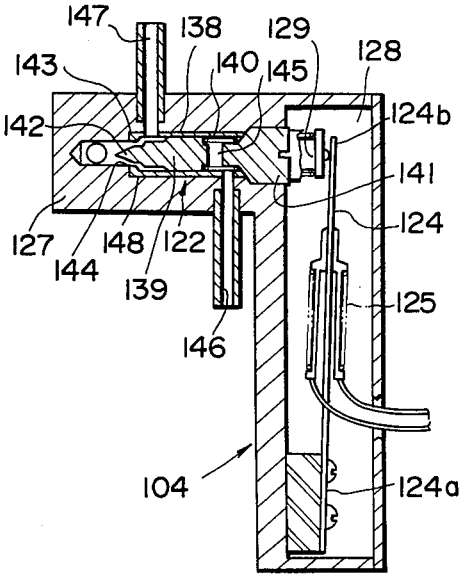
FIG. 8 is a vertical section taken along the line A—A of FIG. 7.

The device 104 can be seen in more detail in FIGS. 7 and 8. The mixture supply path 106 leads, via a jet orifice 151, which regulates the maximum flow rate during cranking of the engine, to the mixing plenum 149. To this mixing plenum 149 are supplied fuel, through a starting fuel control system 121, and air, through a variable air bleed system 122, and through a fixed air bleed 123.

The fixed air bleed 123 is arranged to give the basic flow rate of air for starting the engine, by mixing air into the starting or cranking fuel supply so as to emulsify it.

The starting fuel control system 121 comprises a tubular guide member 131 set in the housing 127 of the device 104, and a plunger 129 which slides in this guide member 131 and whose left hand portion in the figure is formed as a tapered needle 133 which cooperates with the constricted end 134 of the guide member 131 to form a metering jet orifice 135 of variable cross-sectional area. Fuel is introduced into the chamber 136 between the needle 133 and the member 131 through a fuel path 137, and passes past this metering jet orifice 135 to the mixing plenum 149. The plunger 129 is biased in the rightward direction in the figure by a spring 132, and its end abuts on a temperature-sensitive bimetallic element 124 which responds to the temperature generated by a heater 125 and to the engine temperature, and which is disposed in a closed box behind the housing 127. When temperature is low, the upper end **124*b* of the bimetallic element 124 moves rightwards in the figure, and, as temperature increases, the upper end 124*b* of the bimetallic element 124 moves leftwards in the figure, so as gradually to press the plunger 129 leftwards in the figure, against the biasing action of the spring 132. Thus, at low temperatures the orifice 135 is open to a maximum, and as the temperature of the bimetallic element 124 increases this orifice 135 becomes smaller, until the engine reaches operating temperature, when the orifice 135** is substantially fully closed.

The variable air bleed system 122 comprises a tubular guide member 138 set in the housing 127, and a plunger 139 which slides in this guide member 138, whose left hand end in the figure is formed as a tapered needle 142 which forms in co-operation with the constricted left hand end 143 of the guide member 138 a jet orifice 144 of variable cross-section. Air flows into the chamber between the guide member 138 and the needle 142 through an air conduit 147 and flows out through the orifice 144 into the plenum 149, its flow amount being regulated by the size of the orifice 144. The right hand end in the figure of the guide member 138 is blocked by a plug 141, and between the plug 141 and the plunger 139 is a spring 140 which biases the plunger 139 in the leftwards direction in the figure. On the other hand, the plunger 139 is urged in the rightwards direction in the figure by vacuum Pb obtained from below the throttle valve 101, through a conduit 170, a conduit 146, into the chamber 145 formed between the right hand end of the plunger 139 and the plug 141. By the balance of this urging and this biasing, therefore, the plunger 139 finds its position, and the size of the orifice 144 is controlled. According to a particular feature of the present invention, the tapering angle of this needle 142 is sharper and shorter than that of the needle 133 of the fuel system 121, so that the area of the jet orifice 144 changes abruptly, as the needle 142 moves.

This carburetor operates as follows. When the engine is being cranked so as to start it, the vacuum Pb below the throttle valve is zero or extremely low, and therefore the needle 142 is to the left in the figures, and the orifice 144 is substantially closed, and so supplies no air to the plenum 149, which therefore receives air only from the air bleed 123. Further, the bimetal 124 is cold, or at least not warm, and therefore the needle 133 is to the right in the figure, and the orifice 135 is open to a considerable extent, and thus a large amount of choking fuel is provided. Therefore, a rather rich mixture is supplied for cranking. It is particularly to be noted that the richness of this mixture depends upon the temperature of the engine during cranking, since this affects the position of the bimetal 124.

Meanwhile, the piston device 114 controls the amount of opening of the passage 112–113 according to the temperature of the thermowax element 163. Since the functioning of the piston device 114 is exactly the same as in the first embodiment, no further explanation will be given here, for the purposes of simplicity of explanation and description.

Figure 10:
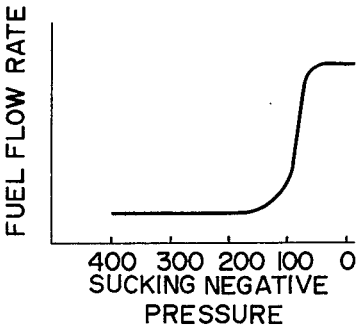

As soon as the engine starts, the vacuum Pb below the needle 142 is sucked righwards in the figures os as to open the orifice 144 and admit much more choking air, so as to weaken the choking mixture to an acceptable A/F ratio. On the other hand, if the vehicle is suddenly accelerated during warming up, then the throttle valve 101 is suddently opened, which lowers the vacuum Pb and allows the needle 142 to move leftwards in the figure, so as to richen the choking mixture. Thus the function of an accelerator pump is provided, during warming up, by this arrangement. FIG. 10 shows variation of A/F with Pb.

Figure 9:
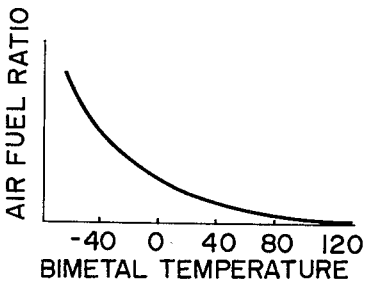
FIGS. 9 and 10 are graphs illustrating performances of choking fuel supply and choking air supply systems of this second embodiment.

Further, during warming up of the engine, as the engine temperature gradually rises, and also because of the action of the heater 125, the bimetallic element 124 bends, and its upper end in the figures drives the needle 133 progressively into the orifice 135 so as progressively to block it, thus progressively weakening the choking mixture. FIG. 9 shows the correlation of the bimetal temperature with the fuel flow rate.

Since the tapering of the needle 142 is rather steep, the air/fuel ratio can be abruptly changed within the range of the vacuum Pb. Thus significantly richened mixture is made available for cranking and acceleration. When the vacuum Pb becomes approximately −150 mmHg, the chamber 145 is reduced substantially to zero size, and the aperture of the orifice 144 becomes maximum. If the vacuum Pb is therefore further increased, the air/fuel ratio does not change, as long as the fuel flow rate does not change.

A PTC heater for maintaining a predetermined temperature can be conveniently used, in which the resistance increases to reduce the electric current when the temperature is exceeded. Furthermore, of course the bimetal 124 may be replaced with a per se well known thermowax pellet or the like, with an equivalent effect.

As can be seen from the above, the device of the present invention requires no large size components such as the conventional automatic choke valve mechanism or ignition diaphragm mechanism. It is particularly suited for a variable venturi carburetor, which is not well adapted to attachment of a conventional choke valve mechanism. Also the components of the present invention are simple and cheap elements. Thus a carburetor according to the present invention is cheap and easy to make and simple to service. Also the functions both of an automatic choke and of an accelerator pump during warming up of the engine are provided by a simple and ingenious mechanism.

Although the present invention has been described in terms of several preferred embodiments, it should not be limited to these, however; or mere and simple generalizations, or other detailed embodiments. Yet further, various alterations to the form and the content of various embodiments could be made without departing from the scope of the present invention which it is therefore desired should be defined not by any of the purely fortuitous details of the shown embodiments, or of the drawings, but by the appended claims, which follow.

We claim:

1. A carburetor comprising:

a mixture passage;

a throttle valve positioned in the mixture passage;

a variable venturi valve postioned in the mixture passage upstream of the throttle valve;

a vacuum-driven actuator which is controlled by the vacuum in the mixture passage between the throttle valve and the variable venturi valve, and which controls the opening of the variable venturi valve so as to keep said vacuum approximately constant;

a variable fuel supplier responsive to the amount of opening of said variable venturi valve, for supplying fuel into said mixture passage and for increasing fuel flow rate approximately in direct proportion to the said amount of opening;

a bypass passage which bypasses the throttle valve in the mixture passage, leading from upstream of the throttle valve to downstream of the throttle valve;

a piston, which is biased in a first direction by a spring, and which is urged in the direction opposite to said first direction by the vacuum downstream of the throttle valve, and whose motion in the said opposite direction progressively intercepts the bypass passage, so that by said piston reaching an equilibrium position determined by the balance of said biasing and said urging, said piston comprises means for adjusting the flow resistance of the bypass passage;

a heat-sensitive element which responds to a temperature which is representative of the temperature of the engine, and which when the engine is in the cold state does not affect the positioning of the piston, but which, as the engine warms up, gradually advances the extreme possible position of the piston in said first direction in said opposite direction, and which, when the engine is fully warmed up, advances the extreme possible position of the piston in said first direction so far in said opposite direction that said piston substantially closes the bypass passage; and means, associated with said piston, for regulating the flow of air to be fed into the fuel supplier to mix with the fuel supplied thereby in an amount which varies from a minimum when said vacuum downstream of the throttle valve is minimum, to a maximum when said vacuum is maximum, and reversely regulating the flow of air fed into the vacuum-driven actuator.

2. A carburetor comprising:

a mixture passage;

a throttle valve positioned in the mixture passage;

a variable venturi valve positioned in the mixture passage upstream of the throttle valve;

a vacuum-driven actuator which is controlled by the vacuum in the mixture passage between the throttle valve and the variable venturi valve, and which controls the opening of the variable venturi valve so as to keep said vacuum approximately constant;

a variable fuel supplier, which is controlled according to the amount of opening of said variable venturi valve, so as to increase its fuel flow rate approximately in direct proportion to the said amount of opening, and which supplies fuel into the mixture passage;

a bypass passage which bypasses the throttle valve in the mixture passage, leading from upstream of the throttle valve to downstream of the throttle valve;

a piston, which is movable in its axial direction and fixed against rotation in said cylinder and which is biased in a first direction, and which is urged in the direction opposite to said first direction by the vacuum downstream of the throttle valve, and whose motion in the said opposite direction progressively intercepts the bypass passage, so that by said piston reaching an equilibrium position determined by the balance of said biasing and said urging said piston adjusts the flow resistance of the bypass passage;

a heat-sensitive element which responds to a temperature which is representative of the temperature of the engine, and which when the engine is in the cold state does not affect the positioning of the piston, but which, as the engine warms up, gradually advances the extreme possible position of the piston in said first direction in said opposite direction, and which, when the engine is fully warmed up, advances the extreme possible position of the piston in said first direction so far in said opposite direction that it substantially closes the bypass passage; and a pair of first and second controlling members provided on the opposite sides of the piston, the first controlling member having a U-shaped groove with a tapered leg being formed at one end portion thereof through which air is fed to the fuel supplier from atmosphere, the second controlling member having a reverse U-shaped groove with a tapered leg being formed at one end portion thereof through which air is fed from atmosphere into the vacuum-driven actuator, in such a way that, on one hand, when the piston is advanced in the opposite direction the U-shaped groove of the first controlling member increases the air to be fed into the fuel supplier and the reverse U-shaped groove of the second controlling member decreases the air to be fed into the vacuum for controlling the vacuum-driven actuator, and on the other hand, when the piston is moved in the first direction the U-shaped groove of the first controlling member decreases the air to be fed into the fuel supplier and the reverse U-shaped groove of the second controlling member increases the air to be fed into the vacuum-driven actuator.

3. A carburetor comprising:

a mixture passage;

a throttle valve positioned in the mixture passage;

a variable venturi valve positioned in the mixture passage upstream of the throttle valve;

a vacuum-driven actuator which is controlled by the vacuum in the mixture passage between the throttle valve and the variable venturi valve, and which controls the opening of the variable venturi valve so as to keep said vacuum approximately constant;

a variable fuel supplier, which is controlled according to the amount of opening of said variable venturi valve, so as to increase its fuel flow rate approximately in direct proportion to the said amount of opening, and which supplies fuel into the mixture passage;

a bypass passage which bypasses the throttle valve in the mixture passage, leading from upstream of the throttle valve to downstream of the throttle valve;

a piston, which is biased in a first direction by a spring, and which is urged in the direction opposite to said first direction by the vacuum downstream of the throttle valve, and whose motion in said opposite direction progressively intercepts the bypass passage, so that by its reaching an equilibrium position determined by the balance of said biasing and said urging it adjusts the flow resistance of the bypass passage;

a heat-sensitive element which responds to a temperature which is representative of the temperature of the engine, and which when the engine is in the cold state does not affect the positioning of the piston, but which, as the engine warms up, gradually advances the extreme possible position of the piston in said first direction in said opposite direction, and which, when the engine is fully warmed up, advances the extreme possible position of the piston in said first direction so far in said opposite direction that said piston substantially closes the bypass passage;

a first air regulation means for admitting air to be mixed with the fuel supplied by the fuel supplier, said first air regulation means responsive to the position of said piston so that as the piston is advanced in said opposite direction said first air regulation means increases this mixed air from a minimum to a maximum, and a second air regulation means for admitting air to be mixed with the vacuum which controls said vacuum-driven actuator, said second air regulation means responsive to the position of said piston so that as the piston is advanced in said opposite direction said second regulation means decreases this mixed air from a maximum to a minimum; and said first and second air regulation means being in combination provided onto the opposite sides of the piston.

4. A carburetor according to claim 3, wherein the heat-sensitive element is a thermowax actuator.

5. A carburetor comprising:

a mixture passage;

a throttle valve positioned in the mixture passage;

a variable venturi valve positioned in the mixture passage upstream of the throttle valve;

a vacuum-driven actuator which is controlled by the vacuum in the mixture passage between the throttle valve and the variable venturi valve, and which controls the opening of the variable venturi valve so as to keep said vacuum approximately constant;

a variable fuel supplier, which is controlled according to the amount of opening of said variable venturi valve, so as to increase its fuel flow rate approximately in direct proportion to the said amount of opening, and which supplies fuel into the mixture passage;

said variable fuel supplier including a fuel nozzle protruding into the mixture passage between the throttle valve and the venturi valve, and a jet needle to be inserted into the fuel nozzle in such a way that the taper of the jet needle cooperates with a fuel jet portion of the fuel nozzle so as to meter the quantity of fuel passed therethrough from a main fuel path;

an air bleed leading to below the fuel jet portion of the fuel nozzle for bleeding air in to be mixed with the fuel;

a bypass passage which bypasses the throttle valve in the mixture passage, leading from upstream of the throttle valve to downstream of the throttle valve;

a piston, which is biased in a first direction by a spring, and which is urged in the direction opposite to said first direction by the vacuum downstream of the throttle valve, and whose motion in the said opposite direction progressively intercepts the bypass passage, so that by said piston reaching an equilibrium position determined by the balance of said biasing and said urging, said piston comprises a means for adjusting the flow resistance of the bypass passage;

a heat-sensitive element which responds to a temperature which is representative of the temperature of the engine, and which when the engine is in the cold state does not affect the positioning of the piston, but which as the engine warms up, gradually advances the extreme possible position of the piston in said first direction in said opposite direction, and which, when the engine is fully warmed up, advances the extreme possible position of the piston in said first direction so far in said opposite direction that said piston substantially closes the bypass passage;

an auxiliary fuel supply device attached on the outer wall of the carburetor, the auxiliary fuel supply device being installed in parallel with, and independently of, the main fuel supply path, the auxiliary fuel supply device being connected through an auxiliary fuel path to below the fuel jet portion of the fuel nozzle so that the mixture supplied thereby is not controlled by the jet needle;

said auxiliary fuel supply device comprising:

a housing;

an air regulation means, provided in the housing, for admitting air to be mixed with the fuel supplied by the auxiliary fuel supply device, said air regulation means responsive to the vacuum downstream of the throttle valve so that said air regulation means supplies an air amount which increases monotonically with increase in said vacuum; and a fuel regulation means, provided in the housing, for admitting fuel into the fuel supplier independently of said variable venturi valve, said fuel regulation means responsive to a temperature which is representative of the temperature of the engine, so as to supply a maximum amount of fuel when the engine is in the cold state, and as the engine warms up to supply progressively less fuel, and to supply substantially no fuel when the engine is fully warmed up.

6. A carburetor according to claim 5, further comprising a bimetallic element which controls the fuel regulation means.

7. A carburetor according to claim 5 or claim 6, wherein the heat-sensitive element is a thermowax actuator.

* * * * *